US009115732B1

(12) United States Patent
Theobald et al.

(10) Patent No.: US 9,115,732 B1
(45) Date of Patent: Aug. 25, 2015

(54) ACTUATOR WITH INTEGRATED FORCE AND POSITION SENSING

(75) Inventors: Daniel Theobald, Sommerville, MA (US); Thomas Allen, Cambridge, MA (US)

(73) Assignee: Vecna Technologies, Inc., Cambridge, MA (US)

( * ) Notice: Subject to any disclaimer, the term of this patent is extended or adjusted under 35 U.S.C. 154(b) by 935 days.

(21) Appl. No.: 12/949,842

(22) Filed: Nov. 19, 2010

(51) Int. Cl.

| | |
|---|---|
| ***F01B 31/12*** | (2006.01) |
| ***F15B 15/20*** | (2006.01) |
| ***F15B 15/14*** | (2006.01) |
| ***F15B 15/28*** | (2006.01) |

(52) U.S. Cl.
CPC ..... *F15B 15/20* (2013.01); *F15B 15/14* (2013.01); *F15B 15/2807* (2013.01); *F15B 15/2815* (2013.01)

(58) Field of Classification Search
CPC ..... F15B 15/14; F15B 15/20; F15B 15/2807; F15B 15/2815
USPC ..... 91/1; 92/5 R
See application file for complete search history.

(56) References Cited

U.S. PATENT DOCUMENTS

| | | | | |
|---|---|---|---|---|
| 4,700,610 | A * | 10/1987 | Bauer et al. | 91/1 |
| 5,396,973 | A * | 3/1995 | Schwemmer et al. | 188/267.1 |
| 5,522,221 | A * | 6/1996 | Kadlicko et al. | 92/5 R |
| 6,691,605 | B2 * | 2/2004 | Rollgårdh | 91/1 |
| 6,971,257 | B1 * | 12/2005 | Evans | 73/7 |
| 8,087,904 | B2 * | 1/2012 | Best | 92/12.2 |

* cited by examiner

*Primary Examiner* — Michael Leslie
(74) *Attorney, Agent, or Firm* — Albert J. Brunett

(57) ABSTRACT

An actuator including a housing and a force sensing mechanism positioned within an interior of the housing and in operable communication with the actuator, the force sensing mechanism capable of measuring the various forces exerted by or on the actuator without losing any of the energy being transmitted by the actuator. A high precision position sensing mechanism can also be included with the actuator.

6 Claims, 1 Drawing Sheet

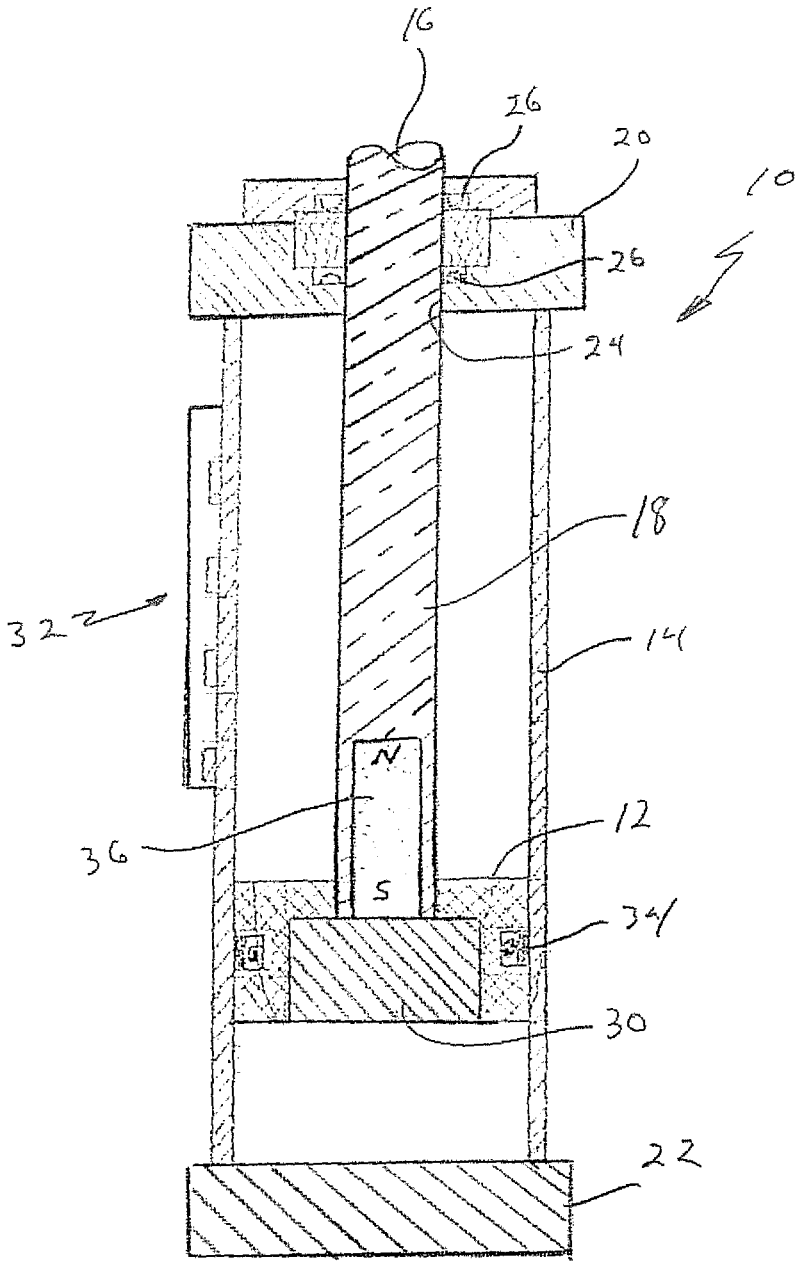
16
26
20
10
26
24
18
32
14
N
36
12
S
34
30
22

ACTUATOR WITH INTEGRATED FORCE AND POSITION SENSING

FIELD OF THE INVENTION

The present invention relates generally to mechanical systems, and more particularly to an actuator for a mechanical system.

BACKGROUND OF THE INVENTION

Actuators typically are mechanical devices that are used for moving or controlling a mechanism or system and typically convert energy into some type of motion. Examples of actuators can be found in any number of applications encountered in every day life including automotive, aviation, construction, farming, factories, robots, health care, and prosthetics, among other areas.

Every mechanical system designed to move or control a mechanism or system must have one or more "prime movers" to provide the work needed and one or more "transmissions" to convey the work from the prime mover to the object that is desired to be moved. Prime movers typically convert electrical or chemical energy to mechanical energy in the form of forces and displacements.

Examples of prime movers may include combustion engines, electric motors, biological/artificial muscles, piezoelectrics, shape-memory-alloys, magnetostrictives and dielectrics, among others. Examples of transmissions may include levers, linkages, wheels, gears, pneumatics and hydraulics, among others.

Hydraulic and pneumatic systems are generally known and typically include an actuator and one or more valves in fluid communication with a pump that provides fluid (hydraulic fluid, air, gas or the like) to the system at a fixed pressure. Such systems tend to be very inefficient, costly and noisy. This is particularly true in systems that rely on "throttling" of fluid through a valve to provide control in the system where fluid is transitioned from high to low pressure without extracting the energy as useful work but instead wasting that energy primarily in the form of heat.

In some applications, it is desirable to know the precise position of the actuator as well as the forces exerted by and on the actuator. This is particularly true in high efficiency and precision applications, such as robots, for example.

SUMMARY OF THE INVENTION

An actuator including a housing and a force sensing mechanism positioned within an interior of the housing and in operable communication with the actuator, the force sensing mechanism capable of measuring the various forces exerted by or on the actuator without losing any of the energy being transmitted by the actuator. A high precision position sensing mechanism can also be included with the actuator.

BRIEF DESCRIPTION OF THE DRAWINGS

The following detailed description will be better understood when read in conjunction with the appended drawings, in which there is shown one or more of the multiple embodiments of the present disclosure. It should be understood, however, that the various embodiments of the present disclosure are not limited to the precise arrangements and instrumentalities shown in the drawings.

FIG. 1 is a cross-sectional view of one embodiment of an actuator of the present invention.

DETAILED DESCRIPTION OF THE INVENTION

The present invention will be described in detail with reference to embodiments that represent examples of the present invention and are not intended to limit the scope of the invention. Although specific elements and configurations are described to provide an understanding of the invention, it is to be understood that the specific embodiments, elements and configurations provided are for illustrative purposes only. Other configurations will be recognized by those of ordinary skill in the art without departing from the teachings of the present invention or the scope of the appended claims.

FIG. 1 illustrates one embodiment of the actuator of the present invention that is generally illustrated by the reference numeral 10.

As mentioned above, an actuator typically is some type of mechanical device used for moving or controlling a mechanism or system and typically converts energy into some type of motion. Examples of actuators can be found in any number of applications encountered in every day life including automotive, aviation, construction, farming, factories, robots, health care, and prosthetics, among other areas.

Although designs may vary, a hydraulic or pneumatic actuator typically takes the form of actuator 10 where a piston 12 is positioned within a cylinder or chamber 14 with the end 16 of a connecting rod 18 of the piston 12 extending to the outside of the chamber 14. The piston 12 is moved back and forth within the chamber 14 so that the rod end 16 can contact various members external to the actuator 10 (not illustrated) to provide the desired effect.

One example of the use of such an actuator 10 would be in robotics (not illustrated) where the rod end 16 typically is connected to another member, say for an arm joint or other type of structure. By moving the rod end 16 back and forth the robot arm can be raised and lowered a desired amount. Complex mobile robots can have dozens of actuators 10 used to provide various motions to the robot. The actuator 10 of the present invention, when utilized with a complex robot or the like, can be used in a system having a plurality of actuators 10 to be controlled by the same hydraulic fluid and control system thereby reducing the number of components and overall weight, among other benefits, and providing uses that previously have been at least impractical if not impossible.

The actuator 10 can be used in any type of hydraulic or pneumatic system or the like and particularly in such systems that include an electronic or other type of control system (not illustrated) for energy efficiency and precise movement, among other features. Such systems can be found, for example, in applicant's co-pending applications Ser. No. 12/705,993, entitled "Passive Impedance Control for an Actuator", Ser. No. 12/705,995 entitled "High Efficiency Actuator, Method, System and Apparatus" and Ser. No. 12/731,270 entitled "Task flexibility for Actuators" the disclosures of which are hereby incorporated by reference. It is to be understood, however, that the actuator 10 of the present invention can be used in any type of hydraulic, pneumatic, electric or any other type of application without departing from the teachings of the present invention.

The control system typically includes some type of CPU (not illustrated) that can be any desired type of CPU so long as it can execute the software and novel algorithms necessary to monitor and control the actuator 10 and system as desired.

The cylinder 14 can be made from any desired material and includes first and second ends 20 and 22. The material of the cylinder 14 can vary and may include any type of metal, plastic or composite material including carbon fiber or any similar type of material so long as it functions as desired.

The first end 20 can include an aperture 24 through which the rod 18 extends to the exterior of the cylinder 14 and one or more seals 26 to seal the rod 18 with respect to the cylinder 14. The second end 22 of the cylinder 14 can be secured to another portion of the system such as through an attachment member or the like (not illustrated).

The actuator 10 also includes a force sensing mechanism 30 and a position sensing mechanism 32 both of which preferably are integrally formed with the actuator 10. As will be described in more detail below, the force sensing mechanism 30 enables the system to directly determine the exact forces provided by and exerted on the actuator 10 while the position sensing mechanism 32 enables the system to know the exact position of the piston 12, both sensing mechanisms 30 and 32 providing a level of precision not previously achieved in the art. Both of these features provide important and extremely precise information for the control system, such as the system utilized in applicant's smart hydraulic actuator or the like.

The force sensing mechanism 30 can be any type of force sensing mechanism so long as it provides the desired features of the present invention. Preferably, the force sensing mechanism 30 is a load cell type of sensor and is integrally formed with the piston 12 or, alternatively, the rod 18. It is to be understood that the type and position of the sensing mechanism 30 can vary. Additionally, to communicate with the CPU or other components of the system, the sensing mechanism 30 can be wireless or wired with the wiring running back through the rod 18 or routed any other way.

The position sensing mechanism 32 can be any type of position sensing mechanism so long as it provides the desired features of the present invention. Preferably, the position sensing mechanism 32 is a wired or wireless type of magnetic field type of sensor that can sense the direction of a magnetic field, but can vary.

The piston 12 includes at least one seal 34 for sealing engagement with the interior of the cylinder 14 as well as at least one permanent magnet 36. The position sensing mechanism 32 senses the direction of the magnetic field from the magnet 36 to in turn determine the position of the piston 12 and the actuator 10. In addition, the use of a sensing mechanism 32 that senses the direction of the magnetic field can determine the orientation of the piston 12 within the cylinder 14 which may be important especially if a round piston 12 is used that may potentially be subject to rotation in use.

By forming the cylinder 14 from a non-magnetic material, some potential interference or distortion in the operation of the position sensing mechanism 32 can be reduced. This may be important when providing fine motion control as described herein.

By measuring the actual forces inside the cylinder 14 rather than outside the cylinder 14 as is typical in the art a more precise measurement can be obtained with levels of certainty not previously possible. Applicant's design not only enables increased system responsiveness, it is more robust and does not deplete system pressure as typical fluid pressure measurement systems do when positioned outside of the cylinder 14.

One of the many benefits of the present invention is the potential reduction of electrical and/or mechanical interference or distortion that can affect a system, particularly a fine motion control system. On the mechanical side, by placing sensors within the cylinder 14 backlash and other distortion from typical sensing mechanisms having mechanical linkages is eliminated. Similar advantages are obtained by eliminating potential sources of electrical interference, such as from metallic materials or other sources of electrical interference.

Applicant has found that these sources of interference or distortion can provide inaccurate measurements that typically are considered negligible in the art yet in the present invention their reduction helps enables applicant to provide the desired fine motion control needed for delicate operations not previously possible, particularly with systems that need to also lift heavy loads. For example, when used with a mobile robot capable of lifting heavy loads the present invention also enables fine motion control to in turn enable delicate tasks such as interfacing with a human body or other fragile items including an egg, for example. This represents an incredible advance in the art that is providing great commercial success for applicant in a variety of applications.

The embodiments of the present disclosure may be implemented with any combination of hardware and software. If implemented as a computer-implemented apparatus, the embodiments of the present disclosure are implemented using means for performing all of the steps and functions described above.

The embodiments of the present disclosure can be included in an article of manufacture (e.g., one or more computer program products) having, for instance, computer useable media. The media has embodied therein, for example, computer readable program code means for providing and facilitating the mechanisms of the embodiments of the present disclosure. The article of manufacture can be included as part of a computer system or sold separately.

Although the description above contains many specific examples, these should not be construed as limiting the scope of the embodiments of the present disclosure but as merely providing illustrations of some of the presently preferred embodiments of this disclosure. Thus, the scope of the embodiments of the disclosure should be determined by the appended claims and their legal equivalents, rather than by the examples given.

It will be appreciated by those skilled in the art that changes could be made to the embodiments described above without departing from the broad inventive concept thereof. It is understood, therefore, that this disclosure is not limited to the particular embodiments disclosed, but it is intended to cover modifications within the spirit and scope of the embodiments of the present disclosure.

We claim:

1. An actuator, comprising;

an actuator housing;

a force sensing mechanism positioned within an interior pressure chamber of the actuator housing and in operable communication with the actuator, the force sensing mechanism capable of measuring both force exerted by the actuator on another member external to the actuator as well as external forces acting on the actuator without losing any of the energy being transmitted by the actuator while eliminating electrical or mechanical interference or distortion to thereby enable more fine motion control of the actuator; and a piston in the interior pressure chamber, wherein the force sensing mechanism is integrally formed with the piston.

2. A piston style actuator for acting on a member external to the actuator, comprising:

an actuator housing;

a piston positioned within an interior pressure chamber of the housing for cooperative moving engagement within the interior pressure chamber of the housing;

an actuator rod operably connected on one end to the piston and an opposite end of the rod extending through an aperture in the housing to an exterior of the housing and being in sealed but movable engagement with the housing aperture;

a force sensing mechanism positioned within the interior pressure chamber of the actuator housing and in operable communication with the actuator, the force sensing mechanism capable of measuring both force exerted by the actuator on the member external to the actuator as well as external forces acting on the actuator without losing any of the energy being transmitted by the actuator while eliminating electrical or mechanical interference or distortion to thereby enable more fine motion control of the actuator; and a high precision position sensing mechanism including a permanent magnet integrally formed with the piston and in operable communication with a magnetic field sensor positioned on the housing so that the position sensing mechanism can directly and precisely determine the various positions of the piston within the housing and, in combination with the force sensing mechanism, enable more fine motion control of the actuator;

wherein the force sensing mechanism is integrally formed with the piston.

3. An actuator for controlling movement of an external member, the actuator comprising:

an actuator housing and a force sensing mechanism within a sealed portion of the actuator housing, wherein the force sensing mechanism is operable to measure force exerted by the actuator onto the external member; and a piston within an internal chamber of the actuator housing, wherein the internal chamber comprises the sealed portion of the actuator housing, and wherein the force sensing mechanism is configured with the piston.

4. The actuator as defined in claim 3, further comprising a rod connected to the piston and extending out of the actuator housing, wherein the force sensing mechanism is engaged with the piston and the rod.

5. The actuator as defined in claim 3, further comprising a position sensing mechanism configured with a sidewall of the actuator housing.

6. The actuator as defined in claim 3, wherein the piston fluidly separates the internal chamber into two sub-chambers, and the force sensing mechanism defines a peripheral portion of one of the sub-chambers.

* * * * *